United States Patent [19]

Sainsbury

[11] 4,209,003

[45] Jun. 24, 1980

[54] SOFTBALL PITCHING MACHINE

[76] Inventor: Thomas E. Sainsbury, 67 Palmer St., Pawcatuck, Conn.

[21] Appl. No.: 827,323

[22] Filed: Aug. 24, 1977

[51] Int. Cl.[2] ..... F41B 3/04

[52] U.S. Cl. ..... 124/7; 124/41 R; 124/50; 273/26 D

[58] Field of Search ..... 124/17, 21, 36, 41 R, 124/49, 16, 7, 50; 273/26 D

[56] References Cited

U.S. PATENT DOCUMENTS

| | | | |
|---|---|---|---|
| 2,815,743 | 12/1957 | Brunderman | 124/36X |
| 3,272,194 | 9/1966 | Egbert | 124/36 X |
| 3,470,859 | 10/1969 | Ponza | 124/36 X |
| 3,606,987 | 9/1971 | Nomura | 124/51 R X |
| 4,004,567 | 1/1977 | Henderson | 124/41 X |
| 4,122,822 | 10/1978 | Scheiwiller | 124/36 X |

*Primary Examiner*—William R. Browne
*Attorney, Agent, or Firm*—Albert W. Hilburger

[57] ABSTRACT

Apparatus for propelling a ball in an underhand manner utilizing a ramp to impart a desired trajectory and direction to the ball. Upon rotation of a cam, an associated follower moves a pitching arm to a cocked position against the bias of a spring. When the follower falls off an extreme portion of the cam upon continued rotation of the cam, the arm is rapidly released and swings through an arc in the course of which it propels the ball along the upper surfaces of the ramp toward a distant location. A supply hopper may be employed adjacent to the propelling apparatus together with an escapement feed mechanism activated by the pitching arm to deliver balls to the ramp one at a time at a location adjacent to the pitching arm in its cocked position.

8 Claims, 4 Drawing Figures

SOFTBALL PITCHING MACHINE

This invention relates to an improved mechanical pitching machine for throwing softballs in an underhand manner by using a fixed ramp to give the ball a desired trajectory and direction.

One object of the device is to duplicate the trajectory of a ball as thrown by a slow-pitch softball pitcher; thus providing an opportunity for soft-ball players to improve batting technique.

Another object of the device is to furnish a form of exercise and entertainment for the public; such as, a commercial batting range.

One specific embodiment of my invention is shown in the accompanying drawings in which:

The sequence of operation is as follows:

The gear motor[4] which is bolted to a pedestal, is energized. The cam[9], which is secured to the output shaft of the gear motor, rotates slowly in a clock-wise manner. The rising surface of the cam contacts the cam roller[10] which is clevised to the cam follower arm[3] which in turn is clamped to a freely rotatable shaft[11] mounted in pillow blocks. This action of the cam roller on the rising cam surface causes the rotatable shaft to rotate through a predetermined angle.

When this angle is reached, the cam follower will have reached the dwell segment of the cam and the shaft[11] will stop rotating. At this point, the machine is cocked as described above. When the cam[9], which has continued to rotate, reaches the end of its dwell segment, the cam follower[10] falls off the cam[9] and allows the rotatable shaft[11] to rotate at an accelerating rate in the opposite direction.

The rotatable shaft[11] has two other parts clamped to it. One is the spring lever[2] and the other is the pitching arm[1]. Since they are all securely fastened to the rotatable shaft[11], they will obviously all rotate together. As the spring lever[2] is rotated to the cocked position, it stretches an extension coil spring[8] one end of which is fastened to the frame[22], and the other to a turnbuckle[12]. The other end of the turnbuckle is fastened to the spring lever[2] in a clevis-type arrangement. The purpose of the turnbuckle is to adjust the spring tension.

The pitching arm[1], which is made from light weight metal tubing, the inside diameter being of sufficient size to accommodate a regulation softball, has an opening in the back large enough to allow a softball to pass through.

When the pitching arm[1] is rotated to the cocked position, it causes a softball to be fed through the opening in the back and drop down onto a ramp[6]. The feed mechanism, which causes the ball to enter the pitching arm, operates as follows.

As the arm[1] approaches the cocked position, the lower portion contacts one end of a lever[13] which pivots in a bracket[14] attached to a chute[7]. The chute holds a supply of balls. The other end of the lever[13] has a ball-feeder plate[15] attached to it, which protrudes through a hole in the chute[7]. The chute has a fixed stop[16] against which the first ball rest. As the lever[13] is actuated by the pitching arm[1], the feeder plate[15] moves upward through the hole in the chute[7] lifting the first ball over the fixed stop[16] through the hole in the rear of the pitching arm[1] and drops down on the ramp[6]. The feeder plate[15] acts as a stop for the second ball in the chute[7].

When the machine is in the cocked position, the ball to be pitched in resting on a fixed ramp[6] constructed of two thin metal plates separated a certain distance apart to support the ball. The ramp[6] is shaped so as to give a certain trajectory and direction to the ball.

Figure 1:
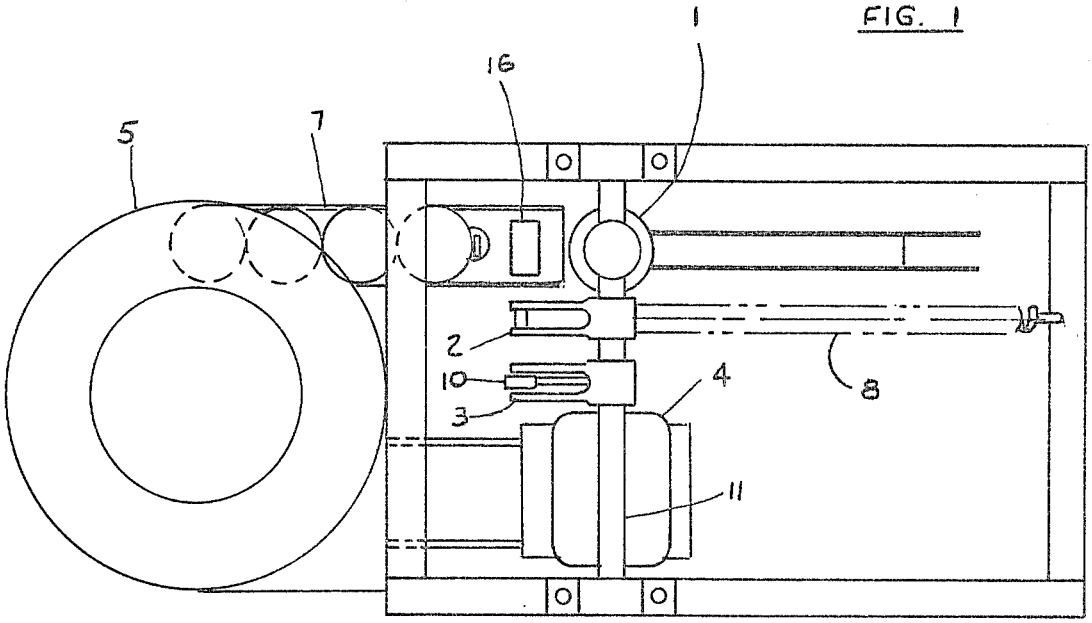
FIG. 1 is a top view showing the locations of the pitching arm[1], the spring lever[2], the cam roller lever[3], the gear motor[4], and the spiral hopper[5], all mounted on a steel frame[22].
Figure 2:
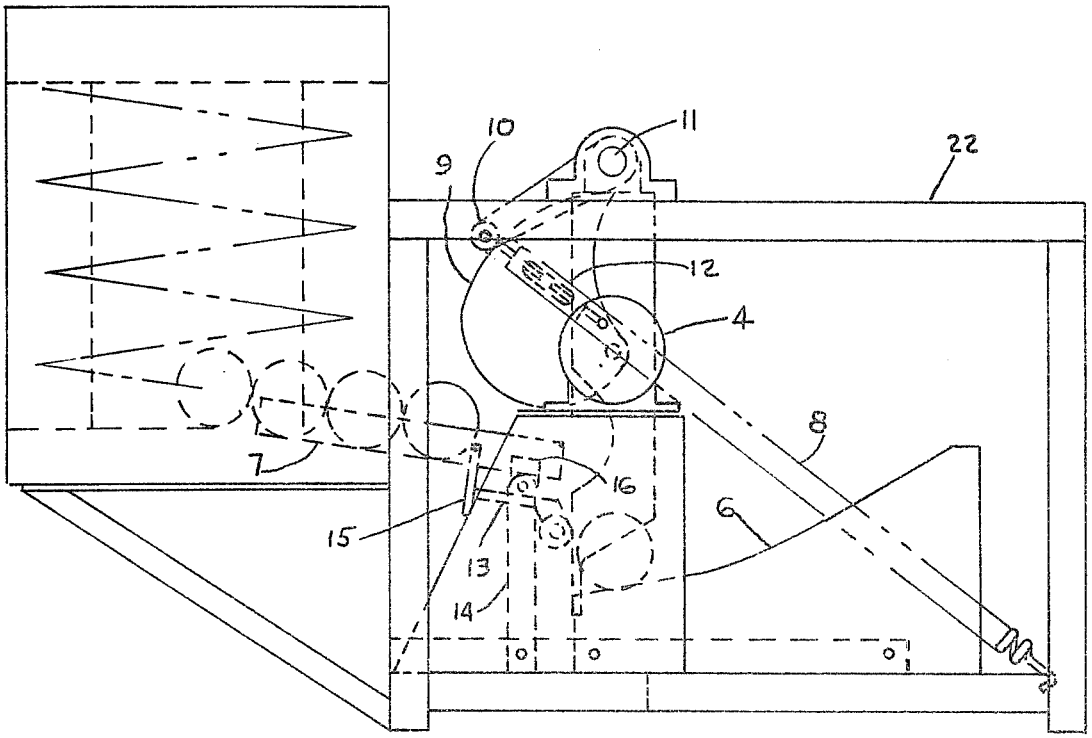
FIG. 2 is a side view showing the ramp[6], chute[7], feed mechanism and spring[8]. This figure shows the machine in the cocked position; that is, the spring is stretched to its proper limit to propel the ball the required distance. The ball is located on the ramp in front of the pitching arm and the cam is on its dwell segment.
Figure 3:
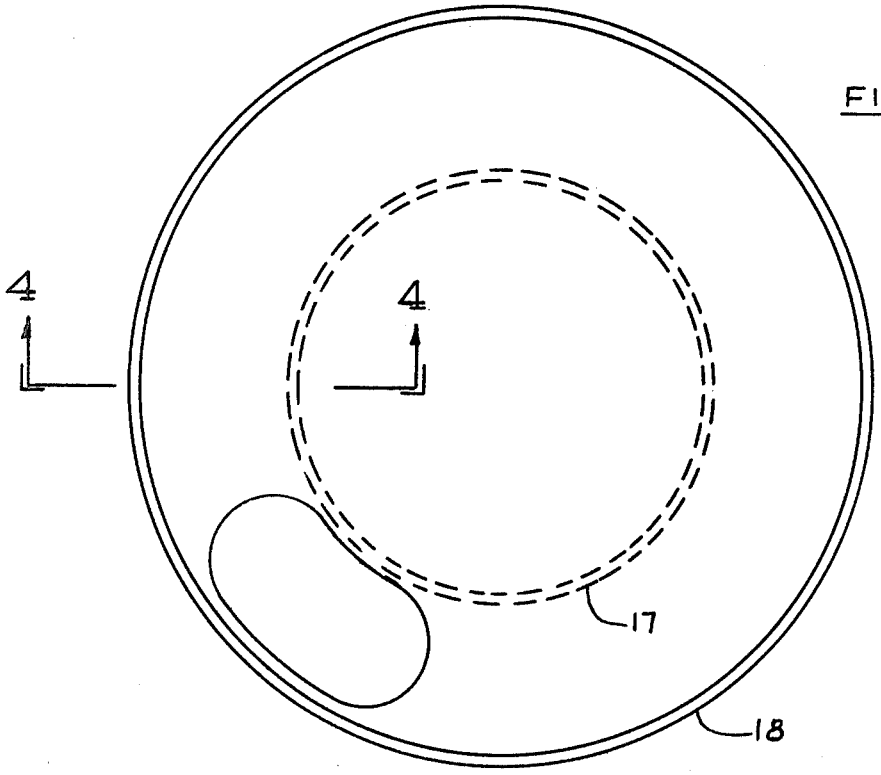
FIG. 3 is the hopper into which the balls are dumped.
Figure 4:
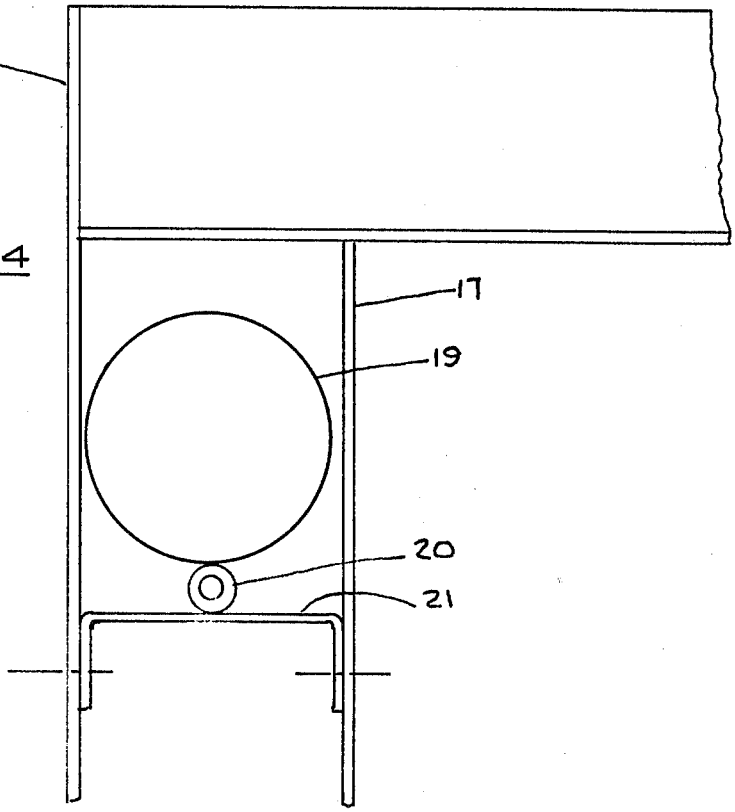
FIG. 4 is a cross section of the inner cylinder.

FIG. 3 is the hopper[5] into which the balls are dumped and is of a cylindrical shape. It comprises an inner cylinder[17] and an outer cylinder[18]. As made further apparent in FIG. 4 which is a cross-section view taken generally along line 4—4 in FIG. 3, the space between the inside wall of the outer cylinder and the outside wall of the inner cylinder is sufficient to allow a softball[19] to pass through. The balls are supported on a flexible tube[20] which in turn is supported by ridges[21] located at proper intervals connecting the inner and outer cylinders. The flexible tube is wound in a spiral manner, thus transporting the balls from the top of the hopper to the bottom in a single row spiral formation. The balls drop from an opening in the bottom of the hopper[5] on to the chute which delivers them to the feeder lever[13] and then into the pitching arm[1] which surrounds the ball and holds it on the ramp[6] until it is fired.

What is claimed is:

1. Apparatus for propelling a ball in an underhand manner comprising:
   - a rotatably mounted shaft;
   - a cam follower fixed on said shaft for rotation therewith and extending radially outwardly therefrom;
   - a cam engageable with said cam follower including a rising surface and a dwell surface, said dwell surface terminating at an extremity;
   - resilient means normally biasing said cam follower into engagement with said cam;
   - drive means operative for rotating said cam;
   - means for propelling a ball to simulate an underhand throw including
   - a ramp having upper surfaces adapted to support and guide a ball; and
   - a pitching arm fixed on said shaft for rotation therewith at a location spaced from said cam follower and extending outwardly from said shaft, said pitching arm lying in and being movable about the axis of said shaft through a plane which is substantially coplanar with a plane of said ramp and coextensive with said upper surfaces, said pitching arm being engageable with a ball when it attains substantially a six o'clock position;

whereby operation of said drive means causes said follower and said pitching arm to be initially rotated in one direction as said follower engages said rising surface, then remain stationary as said follower engages said dwell surface, then rotate rapidly in an opposite direction under the bias of said resilient means as said follower advances beyond said extremity, said pitching arm thereby attaining substantially the six o'clock position and wherein said pitching arm generally surrounds a ball and holds it on said ramp prior to the ball being propelled along said upper surfaces of said ramp toward a distant location;

a generally cylindrical hopper having upper and lower ends and including an inner wall and an outer wall, said inner and outer walls being sufficiently spaced to permit a ball to pass freely between them, and tubular means adapted to support a ball thereon formed in the fashion of a spiral and mounted intermediate said inner and outer walls and extending from said upper end to said lower end of said hopper; and means connecting said hopper and said ramp.

2. Apparatus as set forth in claim 1 including a stationary frame, and wherein said resilient means includes a spring lever fixed on said shaft for rotation therewith at a location spaced from said cam follower and extending radially outwardly therefrom; and a spring extending between a free end of said lever and said frame.

3. Apparatus as set forth in claim 2 including adjustment means extending between said spring and said lever for selectively controlling the spring rate of said spring.

4. Apparatus as set forth in claim 1 including feed means for advancing a ball from said hopper to said ramp.

5. Apparatus as set forth in claim 1 wherein said feed means includes an escapement mechanism.

6. Apparatus as set forth in claim 1 wherein said means connecting said hopper and said ramp includes a chute, an end of said chute distant from said hopper being spaced above said upper surfaces of said ramp, and wherein said pitching arm is movable between an initial position immediately prior to propelling a ball in its path and a final position immediately after propelling a ball toward a distant location, said pitching arm having a hole therethrough greater in diameter than a ball and coextensive with said ramp, and including feed means responsive to movement of said pitching arm from said final position to said initial position for advancing a ball from said chute through the hole onto said ramp at a location adjacent to said pitching arm in its cocked position.

7. Apparatus as set forth in claim 6 wherein said feed means is an escapement mechanism.

8. Apparatus as set forth in claim 6 including a stationary frame, and wherein said resilient means includes a spring lever fixed on said shaft for rotation therewith at a location spaced from said cam follower and extending radially outwardly therefrom; and a spring extending between a free end of said lever and said frame.

* * * * *